US006421869B1

(12) United States Patent
Olsson

(10) Patent No.: US 6,421,869 B1
(45) Date of Patent: Jul. 23, 2002

(54) CLEANING MACHINE

(76) Inventor: Stig Olsson, Bågskyttegatan 2H, S-431 43 Mölndal (SE)

( * ) Notice: Subject to any disclaimer, the term of this patent is extended or adjusted under 35 U.S.C. 154(b) by 0 days.

(21) Appl. No.: 09/446,442

(22) PCT Filed: Jul. 28, 1998

(86) PCT No.: PCT/SE99/01420

§ 371 (c)(1),
(2), (4) Date: Dec. 16, 1999

(87) PCT Pub. No.: WO99/05955

PCT Pub. Date: Feb. 11, 1999

(30) Foreign Application Priority Data

Jul. 29, 1997 (SE) ..... 9702815

(51) Int. Cl.[7] ..... A47L 11/40; A47L 11/03
(52) U.S. Cl. ..... 15/50.1; 15/49.1; 15/98
(58) Field of Search ..... 15/49.1, 50.1, 15/98, 143.1, 52, 144.4

(56) References Cited

U.S. PATENT DOCUMENTS 3,013,288 A 12/1961 Lappin
3,258,803 A * 7/1966 Wolter et al. ..... 15/50.1
3,451,087 A * 6/1969 Jepson et al. ..... 15/50.1
3,518,712 A * 7/1970 Berger ..... 15/50.1
3,673,628 A * 7/1972 Gaudry et al. ..... 15/50.1
4,510,643 A * 4/1985 Kitada ..... 15/50.1

FOREIGN PATENT DOCUMENTS

| | | |
|---|---|---|
| FR | 1267092 | 9/1960 |
| FR | 2229511 | 5/1973 |
| SE | 502450 | 10/1995 |
| SE | 505718 | 10/1997 |

* cited by examiner

*Primary Examiner*—Gary K. Graham
(74) *Attorney, Agent, or Firm*—Orum & Roth

(57) ABSTRACT

The invention relates to an arrangement (1) for a cleaning machine (2) comprising a number of electrically powered rotating disks (3,4) which carry a brush (5) and a hand-held shaft (6) with a fluid supply line (7) for the supply of cleaning fluid (43) to the aforementioned discs (3–4). In accordance with invention, at least two disks (3,4) mounted in mutually opposing directions of rotation and at a relative distance from one another are so arranged as to carry a brush, etc. (5) on their respective outer free end for pressing into contact with the intended surface (8) to be cleaned. The discs (3,4) are supported by a machine (12) supported in such a way as to be capable of pivoting about articulation extending in pairs at an angle to one another. A fluid with a pump is capable of attachment.

19 Claims, 9 Drawing Sheets

FIG.3
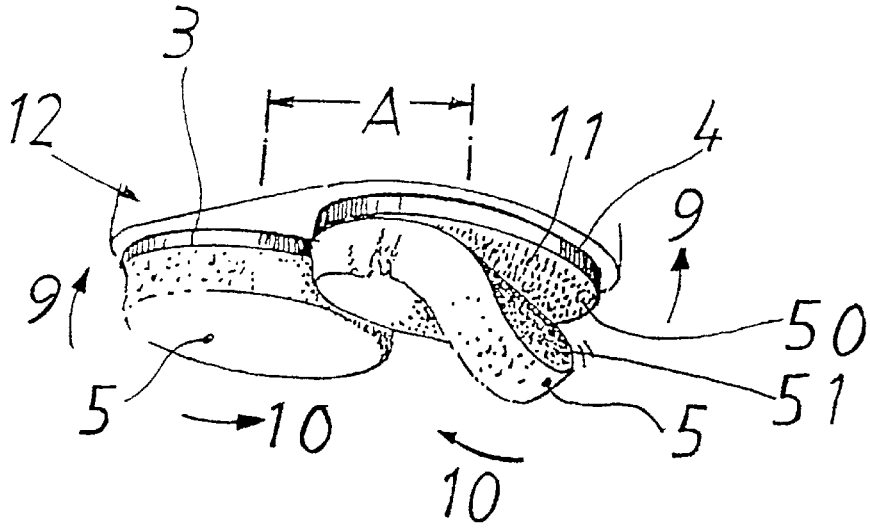
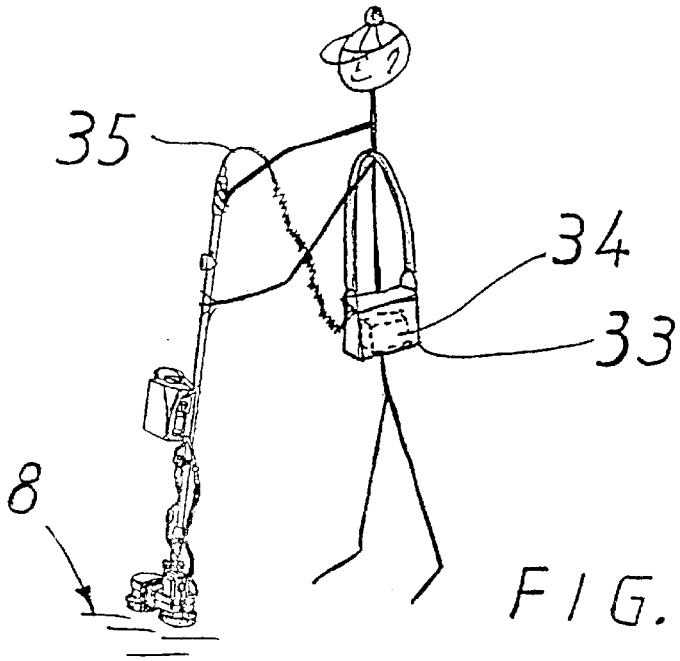
FIG.1A

CLEANING MACHINE

BACKGROUND OF THE INVENTION

1. Field of the Invention

The present invention relates to an arrangement for a cleaning machine comprising at least two disks, mounted in mutually opposing directions of rotation and at a relative distance from one another and so arranged as to carry a brush or other surface treatment device on their respective free end for pressing into contact with the intended surface to be cleaned, and a hand-held shaft with a fluid supply line for the supply of cleaning fluid to the aforementioned discs.

2. Description of Related Art

When cleaning and polishing floors and other surfaces inside buildings, such as stairs and corners, problems are encountered in effectively gaining access and handling existing heavy and cumbersome cleaning machines of the indicated kind. Even in the case of hand-held scrubbing brushes, problems can be encountered in effectively getting into every corner and being able to handle the cleaning fluid effectively.

Previously disclosed is the use of hand-held cleaning machines that exhibit a disc, in conjunction with which it is possible for wandering of the machine to occur in certain positions, sometimes in the wrong direction, which means that an effort must be made to hold the machine in position where cleaning is to be performed. Where more than one disc is used, wandering can also take place if the discs are so arranged as to rotate in the same direction of rotation. Also previously disclosed is the use of hand-held car polishing machines that exhibit two discs, although not intended for cleaning purposes, which are rigidly arranged.

Previously disclosed through SE,B, 8302899-3 (publication number 432 352), for example, is a motor-driven cleaning machine with a shaft, which exhibits two rotating rollers, although these are so arranged as to act with their external envelope surfaces against the intended supporting surface, and the cleaning fluid is so arranged as to be supplied to the rollers from a reservoir. However, this previously disclosed machine does not permit corners, etc., to be reached effectively or allow access to inaccessible cleaning surfaces, i.e. tight up to the edge of skirting boards and furniture.

A cleaning machine previously disclosed through U.S. Pat. No. 3,013,288 exhibits a lower brush component supported by a machine head, which, by means of horizontally oriented screws, is permanently attached in a totally inaccessible fashion inside an outer casing, and which is only capable of pivoting about a horizontal articulation, and has a fluid reservoir supported on a shaft, the function of which is to feed cleaning fluid by gravity through a pipe to the brushes positioned at a lower level than the reservoir.

It is accordingly not possible to remove the machine head easily for hand-held cleaning without using the shaft of the machine, and it is not possible to work with the machine head at a higher level than the tank, since the machine has no pump in the tank and feeding of the cleaning fluid to the machine head functions only by gravity.

The principal object of the present invention is thus, in the first instance, to make available an arrangement capable of solving the aforementioned problems.

SUMMARY OF THE INVENTION

The aforementioned object is achieved by means of an arrangement of the kind indicated above, which is characterized essentially in that the discs are supported by a machine head mounted in such a way as to be capable of pivoting about articulations extending in pairs at an angle to one another, in that a bracket for the aforementioned machine head is so arranged on the outer front end of the shaft as to permit the detachable attachment of the machine head to the shaft, so that the machine can be used hand-held without a shaft, if required, in that the bracket, which constitutes a supporting element for the machine head, is formed by an accommodating component for the machine head that is supported by an outer bearing component, in that a fluid reservoir with a pump is capable of attachment to the shaft, and in that the fluid supply line is connected to the aforementioned machine head.

BRIEF DESCRIPTION OF THE DRAWINGS

The present invention is described below with reference to the drawings, in which FIGS. 1–3 and 4–9 show two separate illustrative embodiments of the arrangement for a cleaning machine, where FIG. 1 shows a perspective view of a cleaning machine in accordance with the invention;

FIG. 1A shows the machine schematically in its operating position;

FIG. 2 shows the lower part of the machine;

FIG. 3 shows the attachment of cleaning pads to the machine;

FIG. 4 shows a perspective view of the second illustrative embodiment of the arrangement in its operating position;

FIG. 5 shows the machine head detached from the shaft;

FIG. 6 shows rotatable brush and polishing discs and their connection to the machine;

FIG. 7 shows a sectioned view of a disc in a position connected to the machine;

FIG. 8 shows a perspective view of a charged fluid reservoir in a position ready for connection to a shaft; and FIG. 9 shows a schematic sectioned view of the reservoir and the shaft in the connected position.

DETAILED DESCRIPTION

Figure 1:
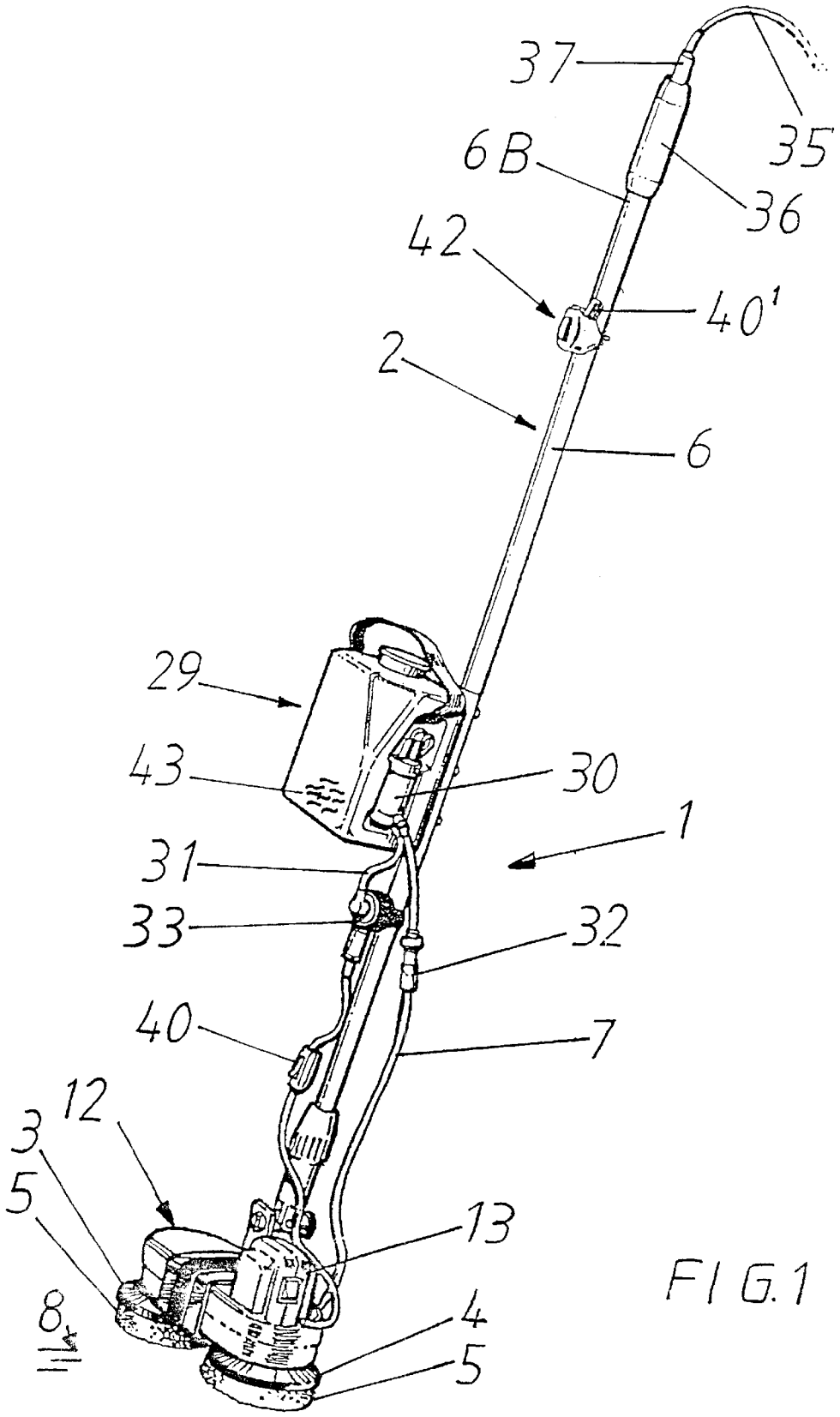
Figure 2:
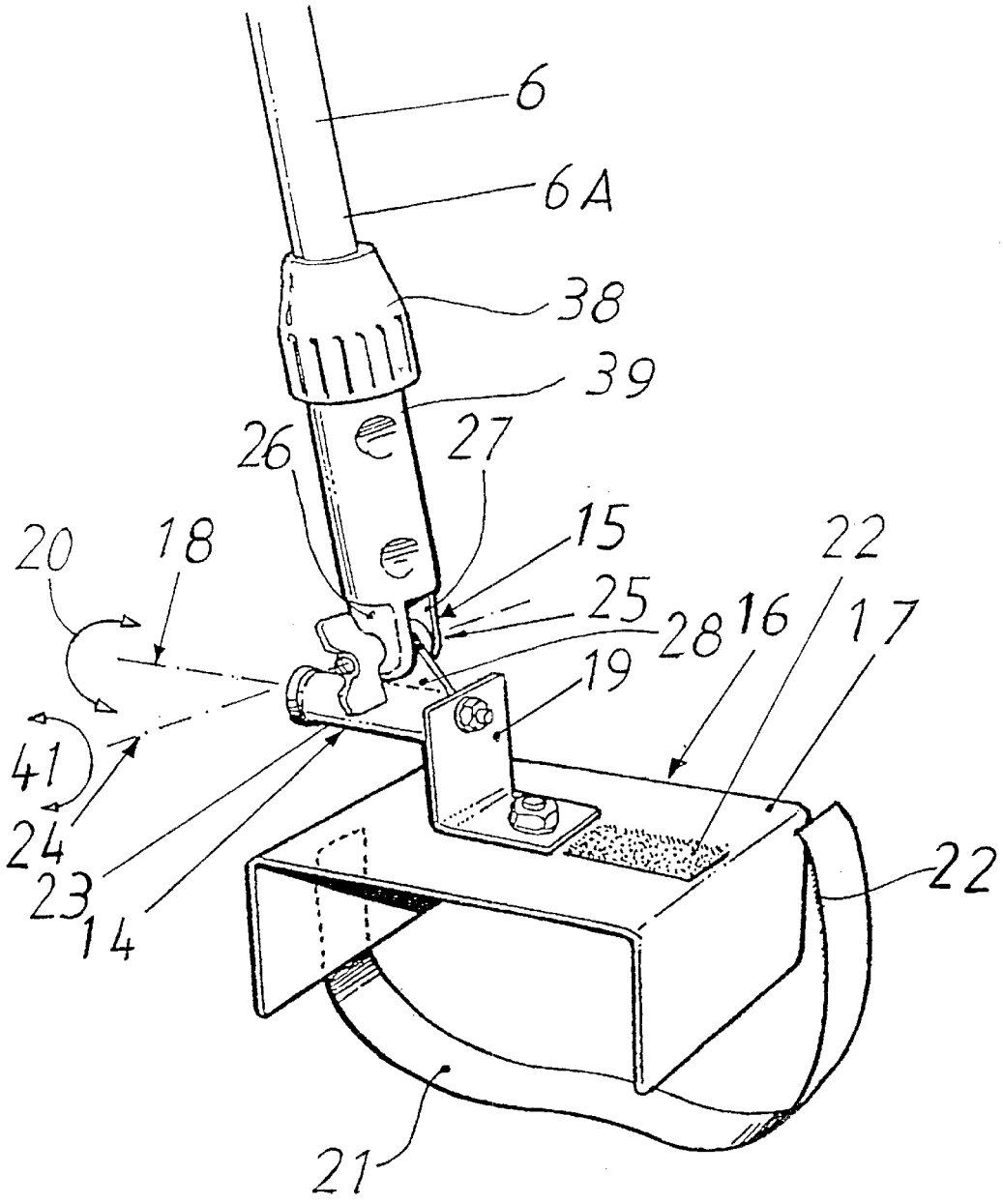
Figure 4:
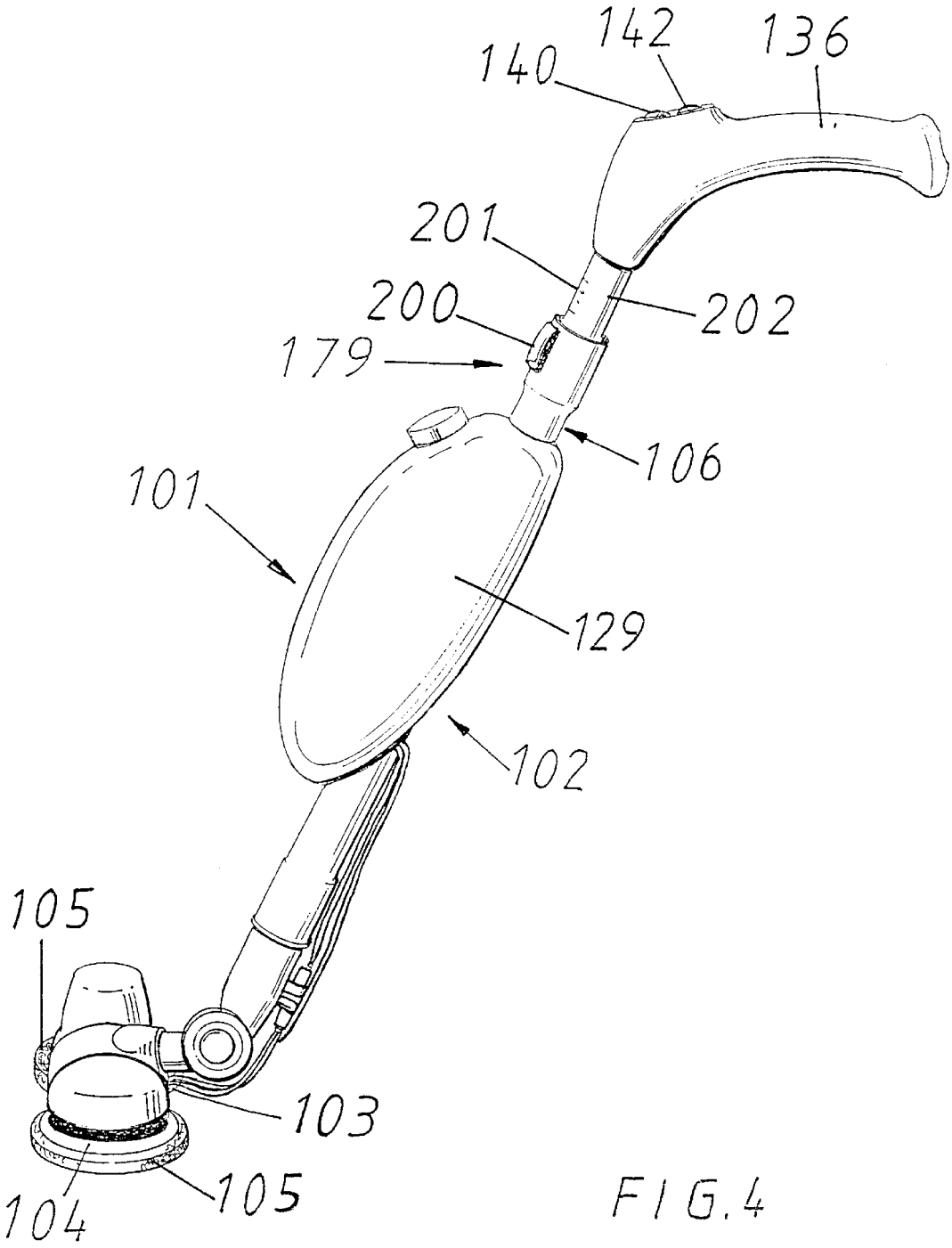
Figure 5:
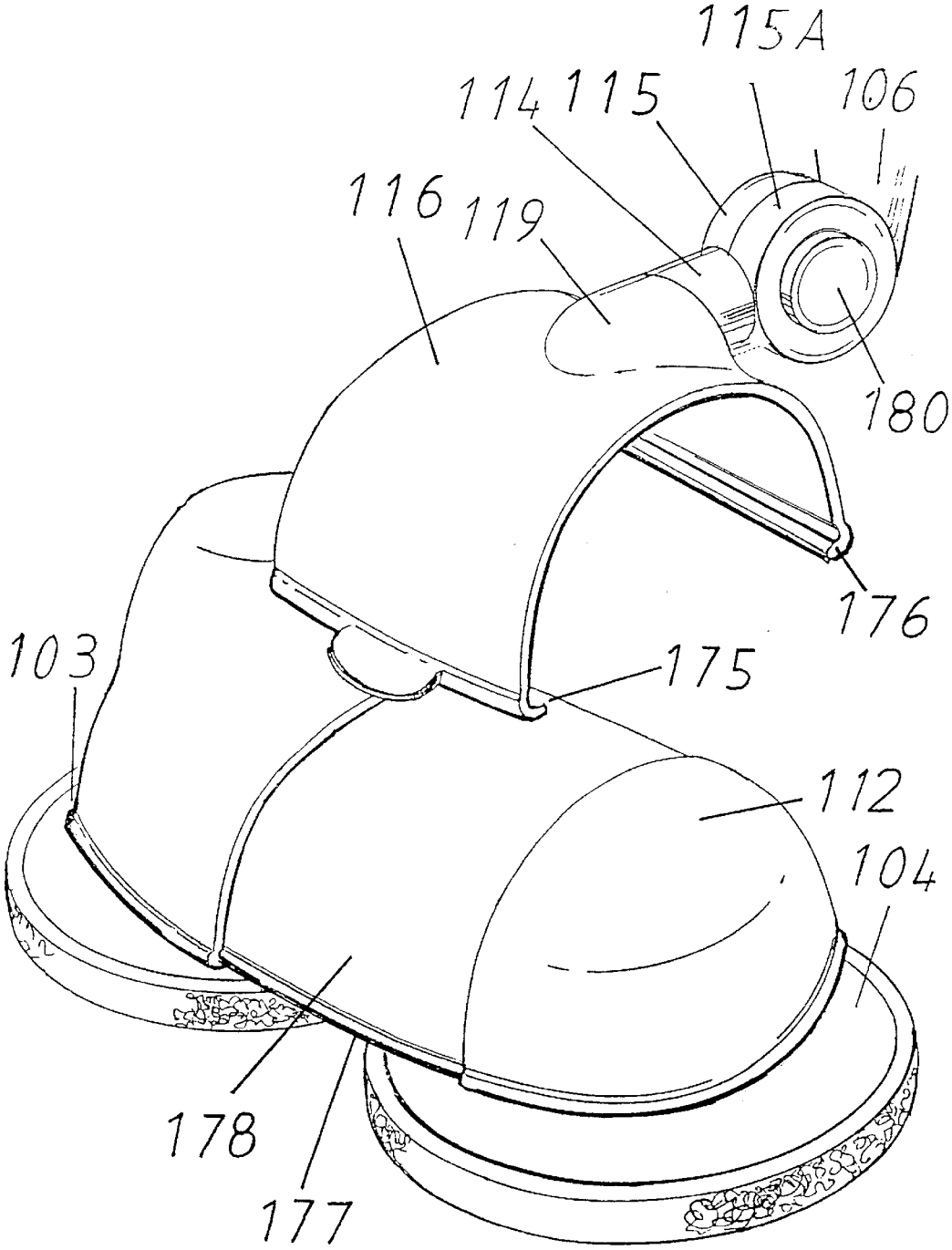
Figure 6:
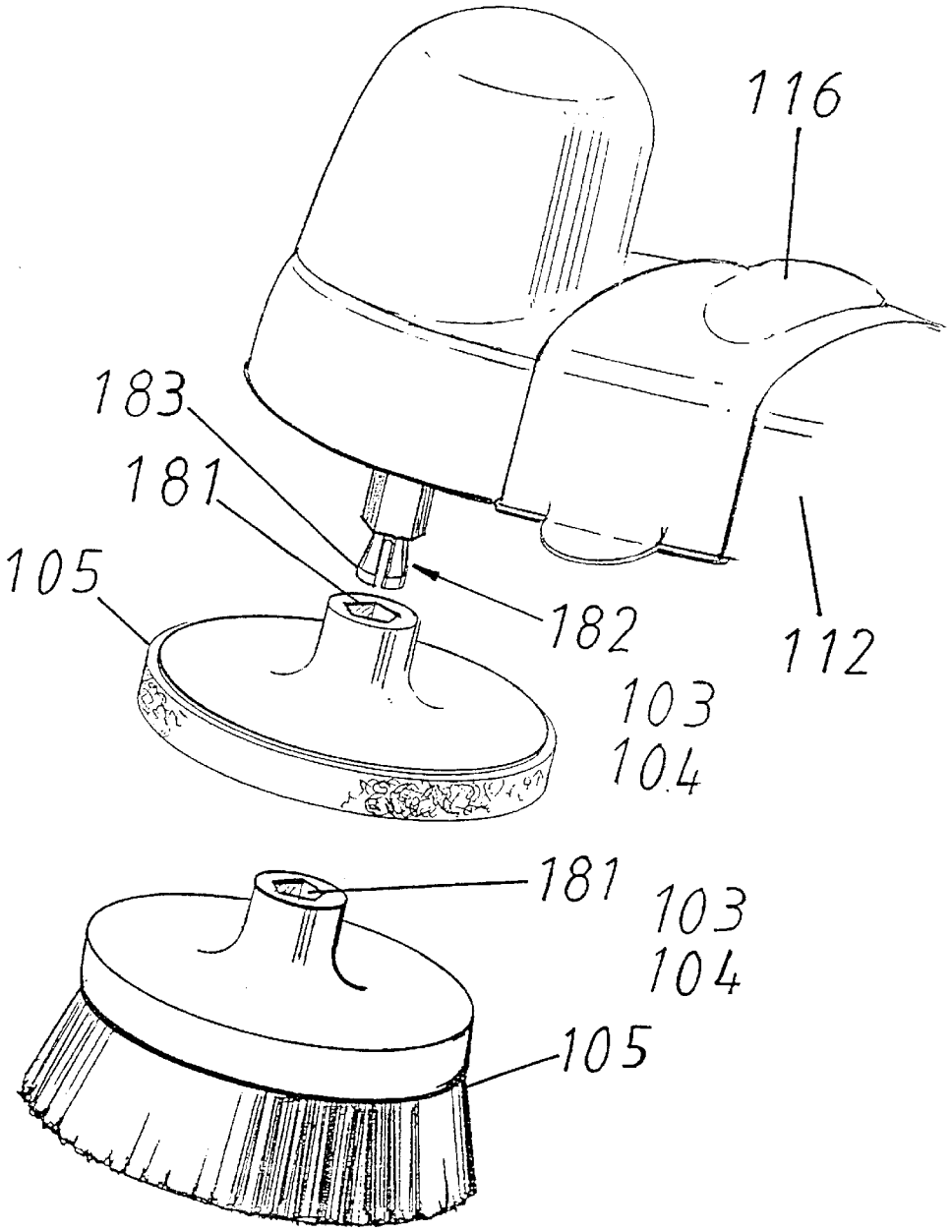
Figure 7:
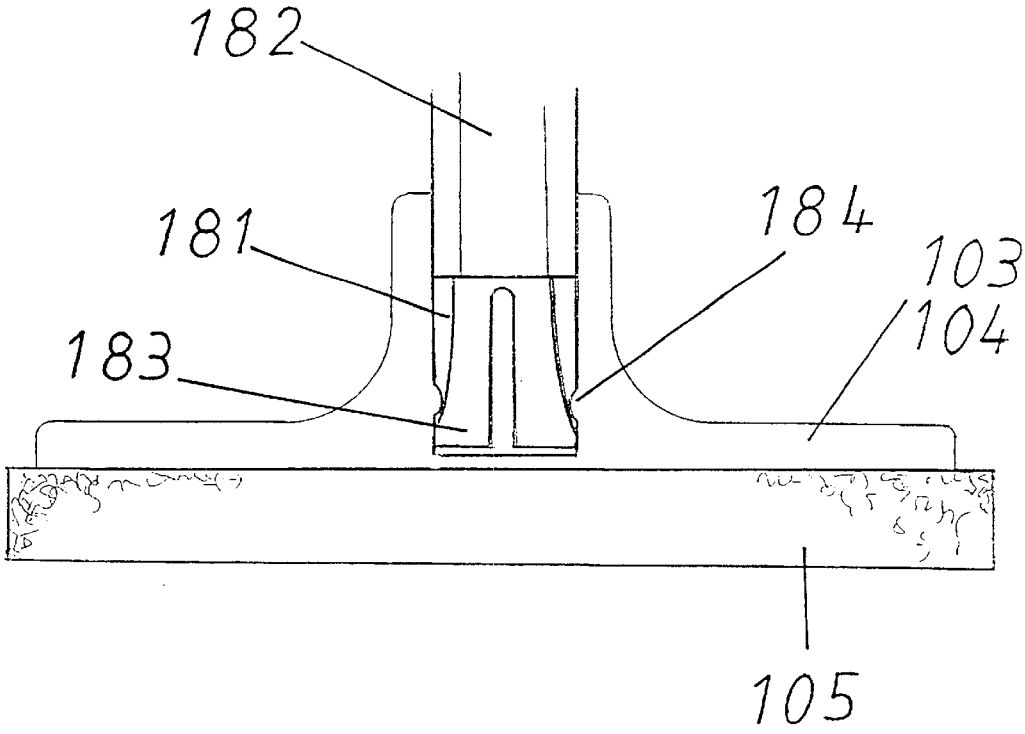
Figure 8:
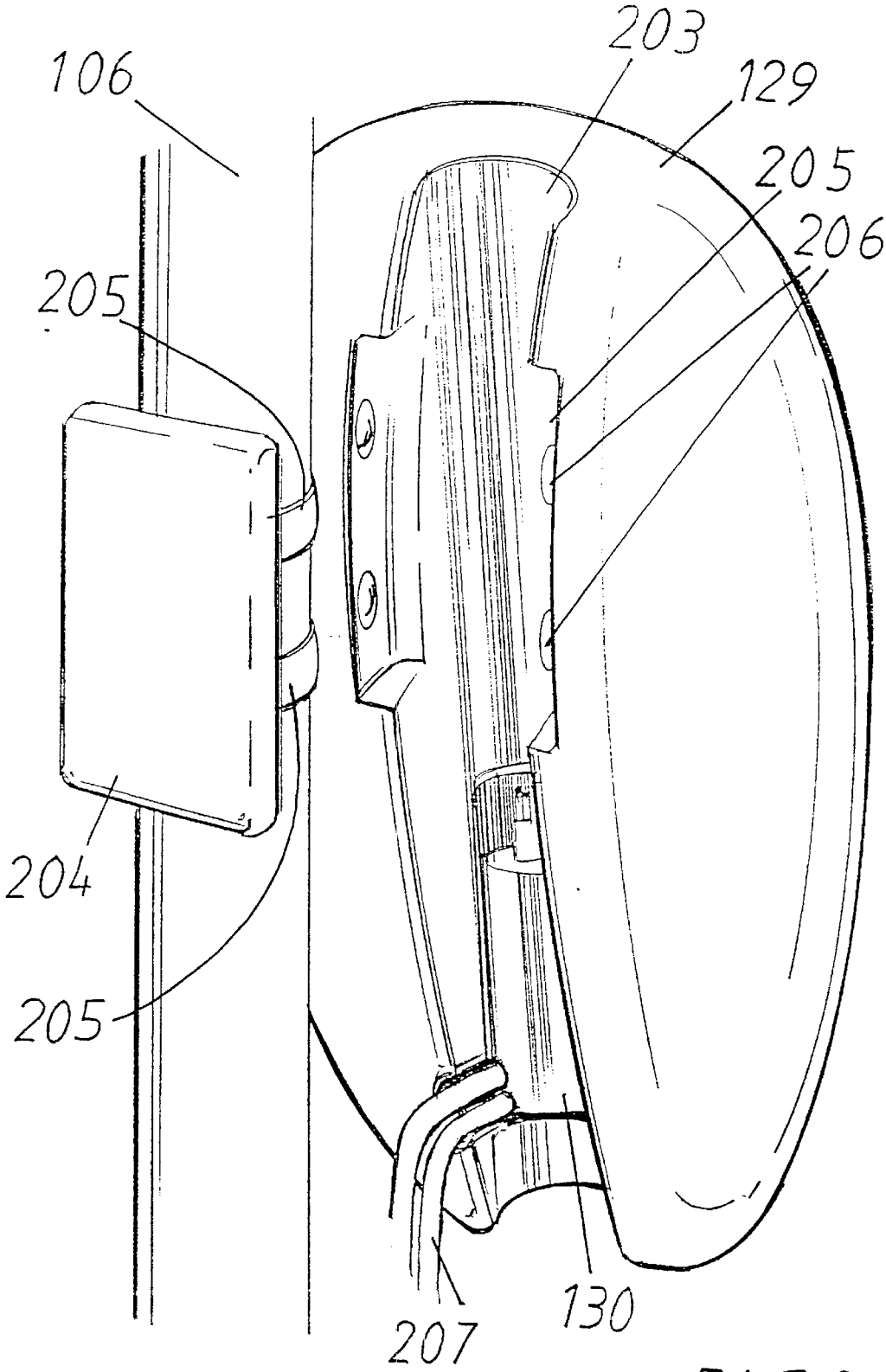
Figure 9:
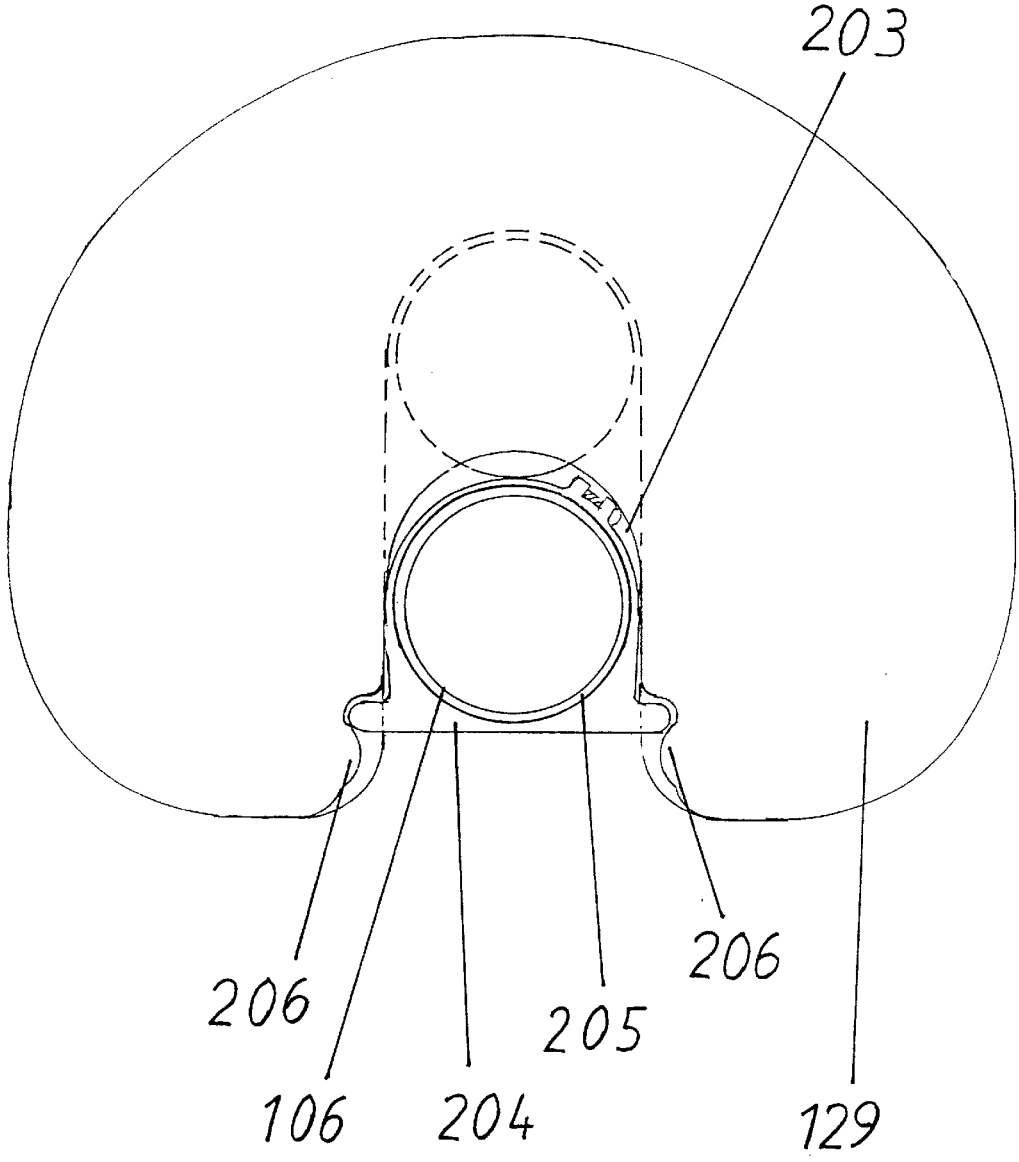

An arrangement 1 for a cleaning machine 2 comprising a number of electrically powered rotating discs 3, 4, which are so arranged as to accommodate brushes, polishing pads, sanding pads, drying pads or other appropriate surface treatment devices 5 intended for attachment thereto on their flat surface, and a hand-held shaft 6 with a fluid supply line 7 for the supply of the intended cleaning agent in liquid form to the aforementioned discs 3, 4 and the intended surface 8 for cleaning, are clearly illustrated in FIG. 1.

The aforementioned arrangement 1 has at least two discs 3, 4 with separate directions of rotation 9, 10 in relation to one another and situated at a relative distance A from one another and so arranged as to carry a brush, etc., 5 on their respective free end 11 capable of being pressed into contact with the intended surface 8 to be cleaned if the need for cleaning arises. The discs 3, 4 are supported by a machine head 12, which contains an electric motor 13 and is mounted in such a way as to be capable of pivoting about pairs of articulations 14, 15 extending at an angle to one another. The aforementioned fluid supply line 7 is also connected to the aforementioned machine head 12.

Thanks to the counter-rotation, the machine 2 is retained in the intended position without wandering uncontrollably of its own accord in an undesired direction.

The components can be detachably attached to one another in a previously disclosed simple fashion by means of Velcro® attachment devices 50, 51 between the respective disc and brush, etc., 5.

A bracket 16 adapted for the head 12 of the aforementioned machine is arranged in the area of the outer front end 6A of the shaft to permit detachable attachment of the machine head 12 to the shaft 6, if required. The aforementioned bracket 16 preferably includes a yoke-shaped accommodating part 17 with a form adapted to the machine head 12 around its periphery and supported by an outer bearing part 19 capable of pivoting about an outer bearing shaft 18, which bearing part is pivotable 20 in relation to the aforementioned outer articulation 14. In this way, the machine 2 can be operated hand-held without a shaft 6, if required.

The machine head 12 can be surrounded and effectively retained, after having been introduced into the aforementioned accommodating part 17, by means of a strap 21, which exhibits means 22 of attachment in the form of, for example, Velcro® fabric, after the strap 21 has been attached to corresponding Velcro® fabric 22 on the accommodating part 17.

The sleeve 23 for the aforementioned outer bearing shaft 18 is accommodated by an inner bearing shaft 24 extending at right angles to the aforementioned outer bearing shaft 18.

Arranged between the two bearing shafts 18, 24 is a friction-actuated adjustment component 25, which is so arranged as to be capable of permitting adjustment of the two bearing shafts 18, 24 relative to one another at a desired angle for rigid attachment or for the adjustment of the shafts 18, 24, so that the components 14, 15 are free to rotate relative to one another against a certain resistance.

The aforementioned adjustment component 25 is formed, for example, by two flanges 26, 27 with holes in one articulation 15 and a centrally located attachment lug 28 with holes in the other articulation 14. The inner bearing shaft 24 is so arranged as to be accommodated in the holes, and a wing nut, wheel or nut, etc., is screwed onto one end 24A of the aforementioned shaft 24 in order, by so doing, to permit clamping of the flanges 26, 27 to the attachment lug 28. The other end of the shaft exhibits a head, although this is not shown here.

Arranged between the flanges 26, 27 and the attachment lug 28 are friction-increasing devices, preferably radial grooves, which increase the clamping force in conjunction with clamping.

A fluid reservoir 29 with a pump 30 is capable of attachment to the shaft 6, and the reservoir 29 can easily be connected to an electrical connection 33 on the shaft 6 and the fluid line 7 via an electrical cable 31 and a fluid line connector 32.

A battery of the kind that contains a gel or some other suitable kind of battery can be accommodated inside a portable bag 43 that the person using the invention can easily carry with him/her during the period when cleaning is taking place, for example over the shoulder or in a back pack. A battery 34 of this kind or the electrical mains supply can be detachably attached via a cable 35 to the outer part 6B of the shaft at a handle 36 to an electrical connection 37 provided at that point.

The shaft 6, which consists of a rod, finally exhibits a length such that it corresponds to the length normally exhibited by a scrubbing brush or a long-handled brush. At its end 6A facing away from the handle part 36, the shaft 6 has a threaded arrangement 38 to permit detachable connection of the shaft 6 to a sleeve-shaped end component 39 on a component 16 for supporting the machine head.

When in the effective cleaning position, the machine head 12 is thus capable, after switching on the motor 13 by means of a starting switch 40 and/or 401, of causing the discs 11 in question to rotate, cleaning the intended surface 8, and being pivoted both about the axis 18 of the outer pivot link 14 in the direction of pivoting 20, and about the axis 24 of the inner pivot link 15 in the desired direction of pivoting 41, by actuation of the shaft 6. If necessary, a switch 42 is actuated to start the tank pump 30 and cause a desired quantity of cleaning fluid 43 to be sprayed from the tank 29 onto the floor 8, for example polish, detergent, water or wax, etc.

The illustrative embodiment of the arrangement 101 for an aforementioned cleaning machine 102, as illustrated in FIGS. 4–9, comprises a bracket 116 made of a plastic material that is curved and resilient and exhibits mutually opposing snap devices 175, 176 on its respective free end to snap into engagement around each projecting part 177 of the machine head 112, thereby being securely clamped around it along an intended fixing part 178. The aforementioned bracket 116 is supported at its one end by the shaft 106 of an outer supporting part 119.

The discs 103, 104 preferably exhibit an opening 181, which is intended to accommodate a rotating shaft 182 in the machine head 112, and the aforementioned opening 181 and shaft 182 exhibit congruent form with a multi-sided periphery, for example in the form of a polygon such as a pentagon.

The rotating shaft 182 exhibits a clamping component 183 on its free end, for example the end of the shaft is slotted so that it can be compressed during connection and spring out again afterwards.

Situated internally in the accommodating opening 181 of the aforementioned discs 103, 104, which can hold a brush, etc., 105, is an inward-projecting thickening 184, such as an annular rim or a number of protrusions, within which the clamping component 183, is adapted to be accommodated.

The shaft 106 is preferably so arranged as to be adjustable in the longitudinal sense and lockable at the desired length by means of an actuation mechanism 179, for example a spring-assisted button 200, which is adjustable along a number of notches 201 on a section of tube 202 inserted inside the shaft.

A shaped fluid reservoir 129, which exhibits a longitudinal external recess 203 shaped to fit the shaft 106, inside which the shaft 106 is capable of being accommodated, is capable of being clamped around the shaft 106 with the help of an enlargement 204 attached to the shaft 106. The aforementioned enlargement 204 can be screwed securely to the shaft 106 by means of a number of clamping rings 205 and is capable of interacting with a number of retaining bodies 206, for example balls in holes, preferably spring-assisted transversely in relation to the shaft, accommodated in a recess 205 shaped to fit the enlargement 204.

A pump 130, present inside which is a suction hose 207 that reaches to its bottom, is attached to the tank in accordance with the foregoing, so that fluid can be pumped to the machine head 12 in all positions.

The articulations 115, 115A between the bracket 116 for the machine head 112 and the shaft 106 are also capable of actuation by a lock 180 so arranged as to change the angle between the shaft 106 and the aforementioned bracket 116. The aforementioned lock 180 is so arranged as to be released by means of a button to vary the angle, so that the machine can easily be adjusted to suit the person who is to use the machine.

Extending at right angles from the axis of articulation of the aforementioned lock is an articulation 114, about which the bracket 116 and the machine head 112 supported by it can rotate when the shaft 106 is caused to rotate. An upper handle 136 contains the switch 140, 142 for the motor and the pump in accordance with the above example.

The invention is not restricted to the illustrative embodiments shown in the drawings and described above, but can be modified within the scope of the Patent Claims without departing from the idea of invention.

What is claimed is:

1. A cleaning machine apparatus (2;103) comprising:

at least two disks (3; 103, 4; 104), having opposing directions of rotation (9, 10) mounted at a relative distance (A) from one another and so arranged as to carry one of a brush (5; 105) and an other surface treatment device on their respective free end (11) for pressing into contact with an intended surface (8) to be cleaned, and a hand-held shaft (6; 106) with a fluid supply line (7; 207) for the supply of cleaning fluid to the discs (3; 103, 4; 104), the discs (3; 103, 4; 104) are supported by a machine head (12; 112) supported in such a way as to be capable of pivoting about articulations (14, 15; 114, 115) extending in pairs at an angle to one another, in that a bracket (16; 116) for the machine head (12; 112) is so arranged on an outer front end (6A) of the shaft as to permit the detachable attachment of the machine head (12; 112) to the shaft (6; 106), so that the machine (2; 102) can be used hand-held without a shaft (6; 106), if required, in that the bracket (16; 116), which constitutes a supporting element for the machine head, is formed by an accommodating component for the machine head (12; 112) that is supported by an outer bearing component (19; 119), in that a fluid reservoir (29; 129) with a pump is detachably attached to the shaft (6; 106), and in that the fluid supply line (7; 207) is connected to the machine head (12; 112).

2. Apparatus as claimed in claim 1, wherein:

the outer bearing component (19) is pivotable about an outer bearing shaft (18).

3. Apparatus as claimed in claim 2, wherein:

a sleeve (23) for the outer bearing shaft (18) is accommodated by an inner bearing shaft (24) extending at right-angles to the outer bearing shaft (18).

4. Apparatus as claimed in claim 3, wherein:

arranged between the two bearing shafts (18, 24) is a friction-actuated adjustment component (25), which permits adjustment of the two bearing shafts (18, 24) relative to one another at a desired angle for rigid attachment and also for the adjustment of the shafts (18, 24) so that they rotate relative to one another against a certain resistance.

5. Apparatus as claimed in claim 4, wherein:

the adjustment component (25) is formed by two flanges (26, 27) with holes and a centrally located attachment lug (28) with holes, and the inner bearing shaft is accommodated in the holes, and in that a clamp means is screwed onto one end (24A) of the aforementioned shaft (24) in order to clamp the flanges (26, 27) to the attachment lug (28).

6. Apparatus as claimed in claim 5 wherein:

friction-increasing devices, preferably radial grooves, are arranged between the flanges (26, 27) and the attachment lug (28).

7. Apparatus as claimed in claim 1 wherein:

a battery (34) or electrical means supply can be attached via a cable (35) to an outer part (6B) of the shaft, where an electrical connection (37) is provided.

8. Apparatus as claimed in claim 1 wherein:

the shaft (6) exhibits a length corresponding to the length of a scrubbing brush and has a threaded arrangement (38) at its end (6A) facing away from a handle part (36) to permit detachable connection to a sleeve-shaped end component (39) on the component (16) for carrying the machine head.

9. Apparatus as claimed in claim 1 wherein:

the accommodating component (16) for the machine-head (12) is in the form of a strap.

10. Apparatus as claimed in claim 1 wherein: the bracket (16) includes an accommodating part (17) with a form adapted to the machine head (12) around its periphery.

11. Apparatus as claimed in claim 10 wherein:

the bracket (116) is curved and resilient and exhibits mutually opposing snap devices (175, 176) on its respective free end to snap into engagement around each projecting part (177) of the machine head (112), thereby being securely clamped around it along a fixing part (178).

12. Apparatus as claimed in claim 1 wherein:

the shaft (106) is adjustable in the longitudinal sense and lockable at the desired length by means of an actuation mechanism (179).

13. Apparatus as claimed in Patent claim 1 wherein:

the discs (103, 104) exhibit an accommodating opening (181) for a rotating shaft (182) in the machine head (112, and in that the opening (181) and shaft (182) exhibit congruent form with a multi-sided periphery.

14. Apparatus as claimed in claim 13 wherein:

the rotating shaft (182) exhibits a clamping component (183) on its free end, the end of the shaft is slotted so that it can be compressed during connection.

15. Apparatus as claimed in claim 14, wherein:

present internally in the accommodating opening (181) of the aforementioned discs (103, 104) is one of an inward-projecting thickening (184) annular rim and a number of protrusions, within which the clamping component (183) is adapted to be accommodated.

16. Apparatus as claimed in claim 1 wherein:

the fluid reservoir (129) exhibits a longitudinal external recess (203) shaped to fit the shaft (106), inside which the shaft is accommodated being clamped with an enlargement (204) attached to the shaft (106).

17. Apparatus as claimed in claim 16 wherein:

the enlargement (204) is screwed to the shaft (106) by means of clamping rings (205) and is capable of interacting with a number of retaining bodies (206) spring-assisted in relation to the shaft (106), accommodated in a recess (205) shaped to fit the enlargement (204).

18. Apparatus as claimed in claim 1 wherein:

the articulations (115, 115A) between the bracket (116) for the machine head (112) and the shaft (106) incorporate a lock (180) to change the angle between the shaft (106) and the bracket (116).

19. Apparatus as claimed in claim 18 wherein:

extending at right angles from an axis of articulation of the lock is an articulation (114), about which the bracket (116) and the machine head (112) supported by it can rotate.

* * * * *

UNITED STATES PATENT AND TRADEMARK OFFICE

CERTIFICATE OF CORRECTION

PATENT NO. : 6,421,869 B1
DATED : July 23, 2002
INVENTOR(S) : Olsson, Stig

It is certified that error appears in the above-identified patent and that said Letters Patent is hereby corrected as shown below:

Title page,
Item [86], PCT Pub. No., change "[86] PCT No.: PCT/SE99/01420" to read
-- "[86] PCT No.: PCT/SE98/01420 --

Signed and Sealed this

Twenty-sixth Day of November, 2002

*Attest:*

*Attesting Officer*

JAMES E. ROGAN
*Director of the United States Patent and Trademark Office*